US005287578A

United States Patent [19]

Lovret

[11] Patent Number: 5,287,578

[45] Date of Patent: Feb. 22, 1994

[54] WIND BREAKUP MEANS FOR SUSPENSION BRIDGES

[76] Inventor: John E. Lovret, 908 Orange St., Clint, Tex. 79836

[21] Appl. No.: 984,552

[22] Filed: Dec. 2, 1992

[51] Int. Cl.[5] ..... E01D 11/00

[52] U.S. Cl. ..... 14/18; 14/78

[58] Field of Search ..... 14/18-20, 14/78; 40/602, 611, 612, 613, 617; 248/291, 324; 256/11, 23

[56] References Cited

U.S. PATENT DOCUMENTS

| | | | |
|---|---|---|---|
| 1,546,094 | 7/1925 | Marbaugh | 256/11 |
| 1,880,290 | 10/1932 | Sunderland | 14/19 |
| 2,926,442 | 3/1960 | Reimel | 40/617 X |
| 3,115,325 | 12/1963 | Batcha | 40/617 X |
| 3,942,868 | 3/1976 | Hoffbauer et al. | 248/324 X |

FOREIGN PATENT DOCUMENTS

| | | | |
|---|---|---|---|
| 1566958 | 5/1969 | France | 40/617 |

*Primary Examiner*—Ramon S. Britts
*Assistant Examiner*—James A. Lisehora
*Attorney, Agent, or Firm*—Nicholas J. Garofalo

[57] ABSTRACT

The invention provides wind flow dissipating units mountable in close relation to one another along the sidewalls of the roadway of a suspension bridge and providing pivotable plates hanging from the units in opposed parallel relation to the sidewalls, the plates being adapted to interfere with and dissipate the force of steady wind blowing toward the sidewalls so as to avoid undesirable resonance swaying of the bridge by the wind.

9 Claims, 2 Drawing Sheets

WIND BREAKUP MEANS FOR SUSPENSION BRIDGES

BACKGROUND AND BRIEF SUMMARY OF THE INVENTION

This invention relates to the provision of new and useful improvements in suspension bridges. More particularly, it is directed to the addition of means to a suspension bridge which will breakup, scatter and deflect high winds flowing toward the bridge, whereby undesirable forces of the winds will be dissipated before they can reach and produce undesirable resonance swaying of the suspended roadway of the bridge.

A particular vexing, potentially dangerous and expensive problem associated with suspension bridges is the swaying of its hanging roadway and the resulting damage to it caused by high winds, particularly strong steady winds. This problem is associated especially to the central part of the roadway, that is the span which usually is the longest and hanging by vertical metal ropes from cables extending between high towers located at opposite sides of a wide waterway or canyon.

A general object of this invention is to improve a suspension bridge with means which will interfere with high wind flowing toward the bridge and will breakup a steady wind in such manner as to avoid the undesirable resonance swaying that it would otherwise bring to the bridge.

In accordance with the invention, wind breakup units are provided to be mounted along opposite sides of the hanging roadway of a suspension bridge. A unit includes a supporting frame which is adapted to be mounted to the sidewall of the roadway, and a metal plate which is pivoted to the frame so as to hang vertically in parallel spaced relation to the sidewall. The units are mountable to the roadway in close relation to one another so as to present along the roadway a wall of closely spaced plates that are swingable on their pivots relative to the frame and to the roadway. In such an arrangement, a driving steady wind flowing toward the bridge will be fragmented and spent in its force and volume in swinging the various plates with an accompanying recoiling, deflection, breakingup and scattering of the wind in various directions. The result will be an exhausted brokenup wind flow reaching the roadway, too spent in energy and volume to produce any undesirable resonance swaying of the roadway.

The particular structure of the invention, its features and advantages will become increasingly apparent as this specification unfolds in greater detail and as it is read in conjunction with the accompanying drawing wherein an embodiment of the invention is set forth. However, it is to be expressly understood that the drawing is for purposes of illustration and description, and it is not to be construed as limiting the scope of the invention.

DETAILED DESCRIPTION OF THE INVENTION

Figure 2:
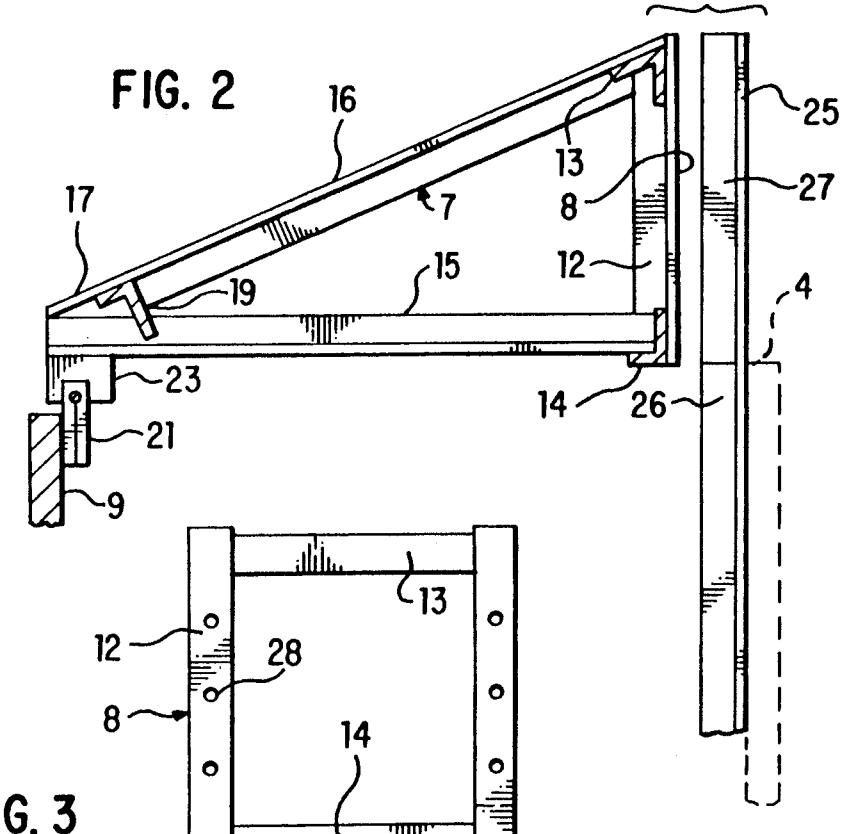
FIG. 2 is a section on line 2—2 of FIG. 1 and showing association of the unit with the sidewall of a suspension bridge.
Figure 3:
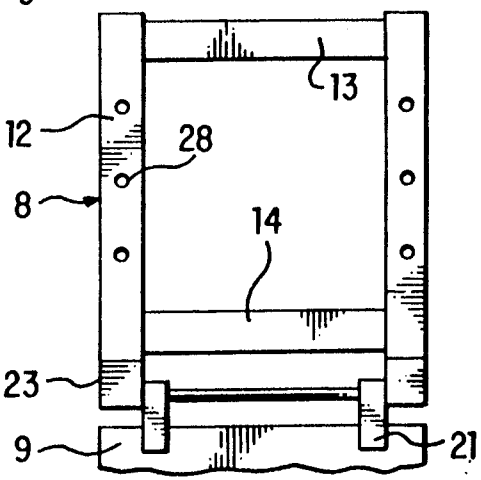
FIG. 3 is a back view of FIG. 1.
Figure 1:
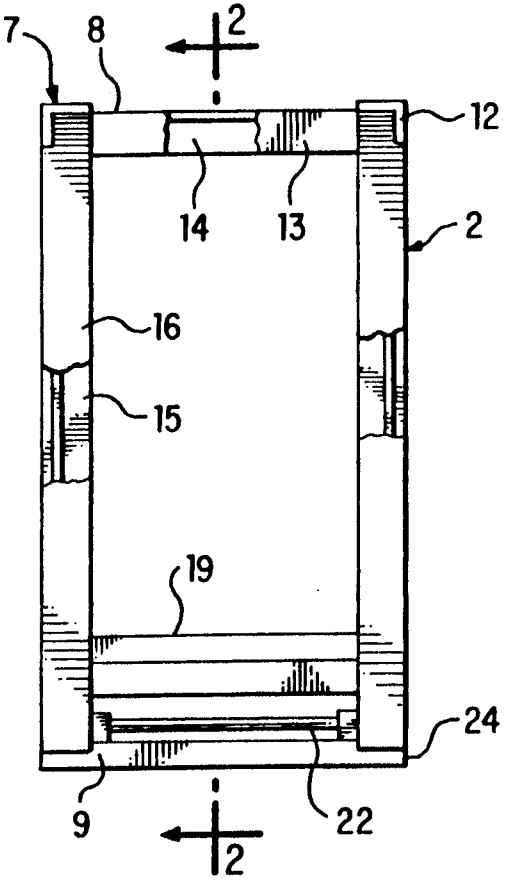
FIG. 1 is a top plan view of a unit embodying the invention and shown apart from the suspension bridge.
Figure 4:
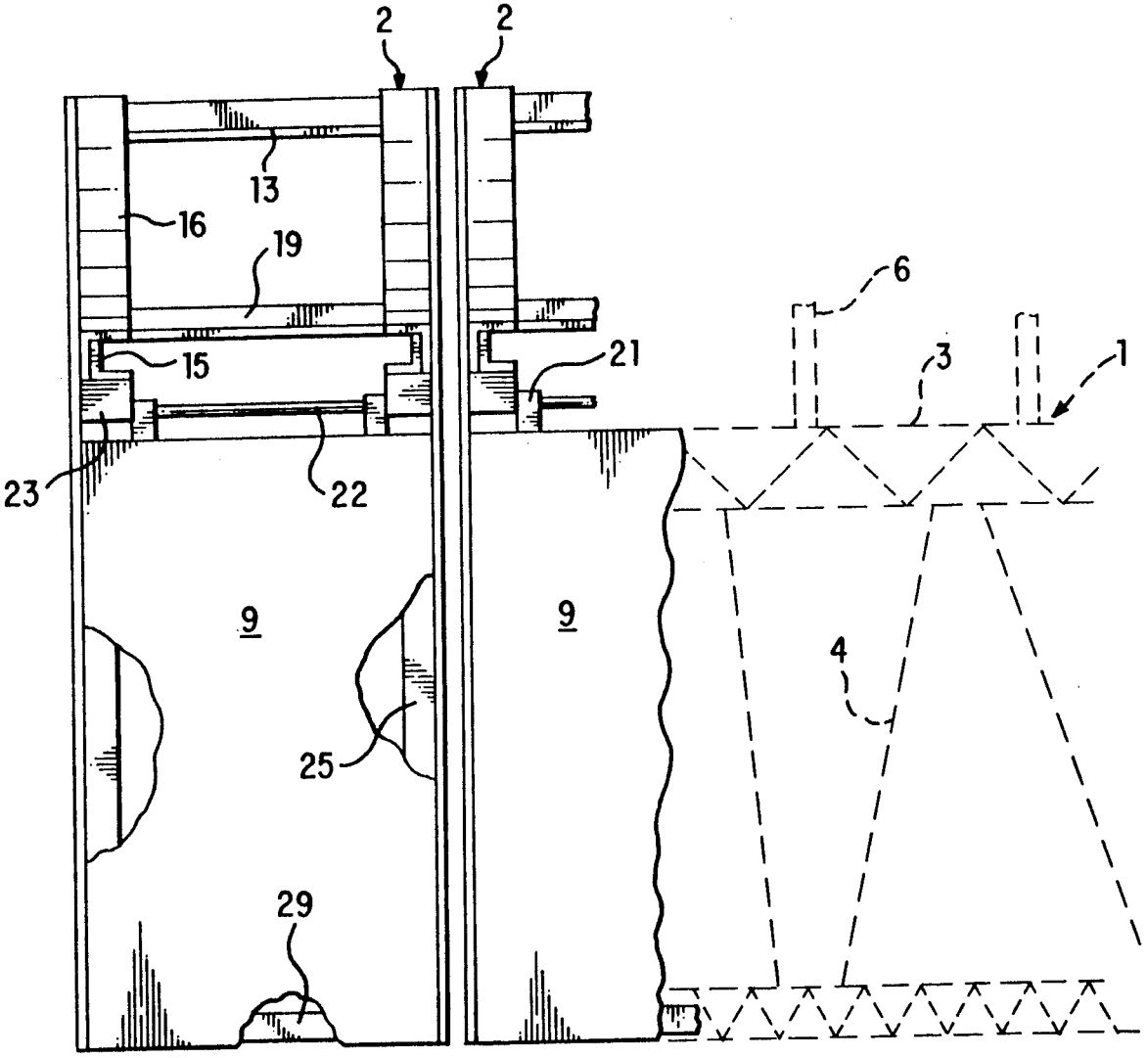
FIG. 4 is a view illustrating units of the invention mounted to a sidewall of a suspension bridge; the bridge being shown in broken line.

In the accompanying drawing there is shown a suspension bridge 1 to which wind breakup units 2 embodying the invention are mounted, as appears in FIG. 4. Only enough of the bridge is shown as will suffice to understand the association of the units to it.

The bridge is of a general suspension bridge construction. It includes a roadway 3 having sidewalls 4. Parallel cables, not shown, extending over high towers are anchored at their ends in concrete blocks. The roadway is suspended from the overhead cables by means of a plurality of vertical steel ropes 6.

The units 2 are designed to be mounted to the sidewalls 4 of the roadway. While the units may be mounted along the entire length of the roadway, they are preferably mounted along opposite sides of its central portion. It is this central portion which spans a wide waterway or canyon and is most vulnerable to the driving forces of high winds.

A unit 2 includes a supporting metal frame 7, which is adapted at its back 8 to be mounted to the sidewall of the roadway. The frame supports at its forward end a metal rectangular plate 9. The plate hangs vertically from its support so as to be in parallel spaced relation to the sidewall 4 of the roadway to which the unit will be mounted.

The supporting frame 7 has at its back 8 a pair of parallel laterally spaced vertical bars 12. A strengthening rib 13, which extends at right angles across the upper ends of the bars, is fixed at its ends to the bars. A second strengthening rib 14, spaced below and parallel to the upper rib 13, is fixed at its ends to the bars. The vertical bars 12, together with the upper and lower ribs 13, 14 provide a rectangular back section 8 to the frame, the bars 12 of which are preferably four feet in height, and the back section 8 is preferably four feet square. A pair of arms 15 extends forwardly from the ends of the lower rib 14 and at right angles to the bars 12. The arms lie parallel to each other in a horizontal plane; and each arm is fixed at its rear to a separate end of the lower rib 14. A pair of downwardly inclined strips 16 extends forwardly from the ends of the upper rib 13. The strips are parallel to each other, and each strip is fixed at its rear to a separate end of the upper rib 13. The forward ends 17 of the strips are fixed to the forward ends of the horizontal arms 15. A further strengthening rib 19 extends across the forward area of the arms 15 and the undersides of strips 16, and it is fixed at its ends to both the arms 15 and the strips 16. The arms 15, together with the rib 14 across the rear of the arms and the rib 19 across the front of the arms provide a rectangular base section to the frame 7. The arms 15 are preferably eight feet four inches in length.

The metal plate 9 is hinged at its top to the forward end of the frame 7, whereby it hangs vertically from the frame. The hinged engagement of the plate includes a pair of laterally spaced tabs 21 fixed to the inner face of plate 9 adjacent the top end of the plate. A hinge pin 22 is fixed in heads of the tabs 21 and projects at its ends from the tabs. One of the projecting ends of the hinge pin is pivoted in a pillow block bearing 23, which is fixed to the underside of a forward end of one of the arms 15 of the frame 7. An opposite projecting end of the hinge pin is similarly associated with the forward end of the other arm 15 of the frame 7.

By means of its hinged engagement with the frame, plate 9 is adapted to be pivoted relative to the frame. The tabs 21 are spaced inward from opposite sides 24 of the plate 9, and they bear lightly against inner faces of the bearing blocks 23. The width of the plate 9 and its hinged relation to the frame 7 is such that the sides 24 of the plate are in alignment with the outer surfaces of the vertical bars 12 of the frame.

A pair of posts 25 is provided which are adapted to be mounted, as by welding, to the sidewall 4 of the roadway of the bridge; and the frame 7, together with the plate 9 depending from its forward end is adapted to be mounted, as by bolting, at its back end 8 to the posts. The posts are of length having a lower portion 26 complementing the vertical height of the sidewall 4 of the roadway 3, and having an upper portion 27 of a length complementing the vertical dimension of the rear bars 12 of the frame 7.

The bars 12, the ribs 13, 14, 19, the arms 15 and the strips 16 of the frame 7, together with the posts 25 to which the frame is mountable are preferably of angle iron form.

To effect a mounting of the frame 7 to the sidewall of the roadway of the bridge, the posts 25 are positioned vertically against the sidewall in parallel lateral spaced relation to each other and are welded in place. The mounted position of the posts is such that their upper portions 27 project above the upper rim of the roadway, and their lower portions 26 are welded to the sidewall 4 of the roadway.

In the act of mounting the unit 2, which comprises the frame 7 and the hinged plate 9, to the bridge, the unit is raised by means of a crane and is positioned to abut its back bars 12 against the upper portions 27 of the posts 25 in such manner that several holes 28 in the bars register with complementary holes, not shown, in the posts. Bolts, not shown, are then inserted into the registered holes and tightened in place, whereby the unit is securely fixed to the sidewall of the roadway. In the mounted condition of the unit its plate 9, which has a vertical dimension complementing the height of the sidewall 4 of the roadway, hangs in spaced relation to and parallel with the sidewall. The plate in its hinged relation to the frame 7 is spaced by the horizontal arms 15 a distance from the sidewall of the roadway, which distance is greater than the length of the plate.

The plate 9 is rectangular. It is preferably of aluminum metal, which is three-sixteenths of an inch in thickness, four feet wide, eight feet in height, and is weighted along the length of its bottom by a cast iron ballast rod 29. The rod may be two and preferably not more than three inches in diameter. A plate of this nature will serve the intended purpose of the unit. However, a rectangular plate having a height corresponding to the vertical dimension of the sidewall 4 of the roadway of the bridge and having a width that is one-half of that height will, together with a ballast rod along its bottom of two and preferably not more than three inches in diameter, produce good results.

In making use of the invention, it is preferred that the units 2 be mounted along each side of the sidewall 4 of the roadway to the extent, at least, of the central span of the bridge; and that they be mounted in such manner that the hinged plate 9 of each unit is spaced close to its neighbor with only enough spacing between them to allow the plates to swing freely relative to each other when buffeted by a driving wind. A three-fourths inch spacing will serve this purpose.

The aerodynamics of what occurs as a high steady wind strikes the various plates 9 of the units embodying the invention is a complex one. However, it sufficies to say that the wind recoils to some extent as it strikes and swings the plates; and concomitant with this recoiling action some of the plates return to a greater extent than others. Accordingly, there is a back and forth swinging of the plates at various angles relative to one another and an accompanying deflecting, breakingup and scattering about of the wind with a consequent loss of its driving energy. The development of this condition, together with the close spacing of the plates to one another renders negligible any remaining energy in whatever portion of the wind escapes beyond the plates to the roadway. Accordingly, no resonance swinging of the hanging roadway will result.

It is preferable that the plates 9 of the various units be non-uniform in weight. By mounting the units 2 to the sidewall of the roadway of the bridge in such manner that the overall weight of the plate 9 of a unit differs from that of its neighbor, there will be an advantageous degree of variance in the swinging of the plates relative to one another in effecting a desirable breakingup and exhaustion of the force of a driving wind before the wind reaches the sidewall of the roadway.

It is preferable that the plates 9 range in overall weight from 88 lbs. to 184 lbs. With plates of this nature, winds having a speed from four to one hundred fifty miles per hour will swing the various plates back and forth, the lighter weighted plates more than the heavier ones; and the extent of this swinging will increase with stronger wind speeds.

While an embodiment of this invention has been illustrated and described in detail, it is to be expressly understood that the invention is not limited thereto. Various changes of form, design or arrangement may be made in its components without departing from the spirit and scope of the invention. It is my intent, therefore, to claim the invention not only as shown and described but also in all such forms and modifications or equivalents thereof as might be construed to be within the spirit of the invention when considered in the light of the specification, the drawing and the appended claims.

What is claimed is:

1. In a suspension bridge including a suspended roadway having opposed sidewalls, the improvement comprising: a succession of pairs of parallel laterally spaced vertical posts mounted along each of the sidewalls, the posts having lower portions mounted to the sidewalls and having upper portions extending up from the sidewalls; and a separate wind breaking unit mounted to each of the pairs of posts, each unit comprising a metal frame having a vertically extending rectangular back section mounted above the lower portions of a pair of the posts to the upper portions of the pair of posts, a rectangular base section extending at right angles in a horizontal plane away from a bottom end of the back section, and a rectangular metal plate pivoted along its top end to an outer end of the base section and depending in a plane parallel to and in spaced relation to the sidewall, wherein the plate has a width complementing that of the base section, a vertical length complementing the height of the sidewall and is spaced by the base section a distance from the sidewall that is greater than the length of the plate, whereby the plate is free to swing under wind forces toward and away from the sidewall and in swinging serves to dissipate energy of the wind flowing toward the sidewall, and the plate of each unit being spaced from its neighboring plates a distance sufficient to allow the plates to swing relative to each other.

2. In a suspension bridge as in claim 1, wherein the plate is of aluminum metal and is weighted along its bottom by a cast iron rod.

3. In a suspension bridge as in claim 2, wherein the plate is four feet in width and three-sixteenths of an inch in thickness.

4. In a suspension bridge as in claim 3, wherein the plates mounted to the sidewall are non-uniform in weight.

5. Wind breakup means adapted to be mounted to a sidewall of a suspension bridge, the means comprising: a pair of posts adapted to be mounted vertically and in laterally spaced relation to each other to the sidewall in such manner that lower portions of the posts are secured to the sidewall and upper portions of the posts extend up from the sidewall; and a metal frame mounted to the posts, the frame having a vertically extending rectangular back section disposed above the lower portions of the posts and secured at its vertical sides to the upper portions of the posts, a rectangular base section extending at right angles in a horizontal plane from a bottom end of the back section, and a rectangular metal plate pivoted along its top to an outer end of the base section, the plate depending from the base section in spaced relation to and parallel to the lower portions of the posts and having a vertical length complementing that of the sidewall but shorter than the distance spacing the plate by the base section away from the posts and from the sidewall in a mounted condition of the means to the sidewall, whereby the plate when subjected to a driving wind is adapted to swing back and forth and to dissipate energy of the wind as it swings.

6. A wind breaking unit as in claim 5, wherein the metal plate is aluminum and is weighted along its bottom by a cast iron rod.

7. A wind breaking unit as in claim 6, wherein the cast iron rod may be selectively two to three inches in diameter.

8. A wind breaking unit as in claim 5, wherein the metal plate is four feet wide and its vertical dimension complements the vertical dimension of the sidewall of the roadway to which the unit is to be mounted.

9. A method for avoiding resonance swaying developing in the suspended roadway of a suspension bridge as a result of high steady winds flowing toward the sidewalls of the bridge, the method comprising: mounting along both sidewalls of the roadway a succession of pairs of parallel vertical posts in such manner that lower portions of the posts are secured to the sidewalls and upper portions of the posts extend up from the sidewalls; and mounting to the upper portions of each pair of posts a wind breaking unit, which unit comprises in its mounted condition a vertical rectangular back section secured at its vertical sides to the upper portions of the posts above the lower portions of the posts, a rectangular base coction fixed at a rear end thereof to and extending in a horizontal plane at right angles from a bottom end of the back section, and a rectangular metal plate pivoted at its top to an outer end of the base section and depending from the base section in parallel spaced relation to the sidewall, the plate having a lateral dimension complementing that of the base section and a vertical length complementing the height of the sidewall, the plate in its depending condition being spaced from the sidewall a distance greater than the length of the plate and subject to being pivoted relative to the base section by winds flowing toward the sidewall, and the plate as it pivots serving to dissipate energy of the winds before the wind reaches the sidewall.

* * * * *